US006269502B1

(12) United States Patent
Exstrom

(10) Patent No.: US 6,269,502 B1
(45) Date of Patent: Aug. 7, 2001

(54) METHOD AND APPARATUS COMBINING PACIFIER, PACIFIER HOLDER AND SWADDLING BLANKET FOR EXTENDED PACIFICATION OF INFANTS

(76) Inventor: Patricia T Exstrom, 544 Uluhaku St., Kailua, HI (US) 96734

( * ) Notice: Subject to any disclaimer, the term of this patent is extended or adjusted under 35 U.S.C. 154(b) by 0 days.

(21) Appl. No.: 09/449,818

(22) Filed: Nov. 26, 1999

(51) Int. Cl.[7] ..... A47C 9/00
(52) U.S. Cl. ..... 5/655; 5/503.1
(58) Field of Search ..... 5/655, 494, 496, 5/503.1

(56) References Cited

U.S. PATENT DOCUMENTS 2,451,718 * 10/1948 Corrao ..... 248/105
4,895,327 * 1/1990 Malone et al. ..... 248/102
5,979,843 * 11/1999 Beck ..... 248/102
6,120,092 * 9/2000 Asad ..... 5/503.1

* cited by examiner

*Primary Examiner*—Lynne H. Browne
*Assistant Examiner*—Fredrick Conley
(74) *Attorney, Agent, or Firm*—Michael I. Kroll

(57) ABSTRACT

The present invention 10 discloses a method and apparatus for holding a pacifier 54 within a pacifier holder 20. In one embodiment the pacifier 54 is internally secured by means 52 within a rolled quilt holder 20 with the nipple 64 projecting from the rolled holder 20 having a means 62 for securing the holder 20. Additionally, methods are described for wrapping an infant 12 in a blanket 14 in such a way as to prevent movement of the arms and legs of the infant 12 so that the infant can properly access the pacifier 54 and holder 20.

3 Claims, 19 Drawing Sheets

METHOD AND APPARATUS FOR USING PACIFIER PARTNER

METHOD AND APPARATUS COMBINING PACIFIER, PACIFIER HOLDER AND SWADDLING BLANKET FOR EXTENDED PACIFICATION OF INFANTS

BACKGROUND OF THE INVENTION

1. Field of the Invention

The present invention relates generally to pacifier holders and swaddling blankets and, more specifically, to a method and apparatus for soothing an infant comprising a pacifier, pacifier holder and swaddling blanket. The pacifier is internally secured with the nipple projecting from a rolled quilt having securement means for selectively attaching a pacifier, and hook and loop material providing means for holding the rolled state of the quilt. In addition, a swaddling-like blanket having one corner folded toward the center and permanently stitched is used to provide security for the infant as well as preventing movement of the arms and legs of said infant. The specific method for securing the infant and the positioning of the pacifier are illustrated in the drawings. It should be noted that the specific steps taken in swaddling the infant can be varied as long as the infant's appendages are restricted in movement. Further the description of the positioning of the infant and pacifier within a crib is for illustrative purposes only and can be easily applied to a car seat wherein the infant is placed in a non-movable position and the pacifier/pacifier holder is supportively position relatively to the infants mouth as hereinafter described.

2. Description of the Prior Art

There are other swaddling and/or pacifier holding devices designed for infant use. Typical of these is U.S. Pat. No. 5,046,204 issued to Mohler on Sep. 10, 1991.

Another patent was issued to La Rocca on Nov. 23, 1993 as U.S. Pat. No. 5,263,975. Yet another U.S. Pat. No. Des. 326,917 was issued to Roberts et al. on Jun. 9, 1992 and still yet another was issued on May 23, 1995 to Li as U.S. Pat. No. 5,416,938. Another patent was issued to Kline on Dec. 15, 1998 as U.S. Pat. No. Des. 402,760. Yet another U.S. Pat. No. 5,781,946 was issued to McEntire et al. on Jul. 21, 1998. Another was issued to Coates on Mar. 21, 1989 as U.S. Pat. No. Des. 300,281.

U.S. Pat. No. 5,046,204

Inventor: Steven Mohler

Issued: Sep. 10, 1991

An article for wrapping an infant comprises a sheet of fabric material, such as blanket material, quilting or baby bunting, having a generally triangular left-handed, a generally triangular right-hand side flap, first and second booties or stocking feet depending from lower regions of the sheet for receiving the feet of an infant resting along a vertical central region of the sheet, and a hood in upper regions of the sheet for receiving the head of the infant. The side flaps each have a sufficient sideward length to enable the flaps to wrap sidewardly over the infant when it is resting along the vertical center region of the sheet and to overlap one another by a substantial amount. The article includes strips of hook and loop fabric for releasably securing the side flaps together when they are in the overlapped condition. The sheet is sized so that an infant resting along the vertical region of the sheet can have its head in the hood and its feet in the booties or stocking feet.

U.S. Pat. No. 5.263.975

Inventor: Mechelle La Rocca

Issued: Nov. 23, 1993

A pacifier tether for use in conjunction with a pacifier to enhance developmental reflexes in an infant. The tether has a generally elongated body. The body has an upper fabric layer having a central portion and a first and second extensions extending from the central portion, and first and second fabric layers underlying the first and second extensions, respectively, and stitched thereto. A reinforcing disk, preferably formed of several fabric layers, overlies the central portion of the upper fabric layer and is stitched thereto. An aperture is formed in the reinforcing disk and the central portion of the upper fabric layer for receiving the nipple of a pacifier. The reinforcing disk maintains the nipple in an upright midline position and insures that the infant's nose remains spaced from the fabric. The pacifier tether further includes a reinforced pocket underlying the aperture. The pacifier base is retained in the pocket.

U.S. Pat. No. Des. 326.917

Inventor: David L. Roberts et al.

Issued: Jun. 9, 1992

This United States Patent discloses an ornamental design for a retaining strap for pacifier, as illustrated in the drawings of the patent.

U.S. Pat. No 5,416,938

Inventor: Jung-Lin Li

Issued: May 23, 1995

A fastener for preventing quilts from being kicked off is provided. The fastener includes a quilt and a wrapping sheet which have corresponding hook-and-loop type fasteners for wrapping a child's body and firmly securing the quilt over the child.

U.S. Pat. No. Des. 402.760

Inventor: Maggie R. Kline

Issued: Dec. 15, 1998

This United States Patent discloses an ornamental design for a combined pacifier with holder and removable fabric pacifier securement means, as illustrated in the drawings of the patent.

U.S. Pat. No. 5.781,946

Inventor: Wanda M. McEntire

Issued: Jul. 21, 1998

A novel/blanket/seat cover (7) for portable infant car seat or apparatus comprising of a flat cross-shaped member (8) having a mid section area (9), a right side extension (10), a left side extension (11), a lower extension (12) and an upper extension (13) each extension having a fold line (24) common to said mid section area (9) allowing each extension to be folded, a strap (14) located on each side of said mid section area (9), a leg pocket member (15) having an attachment means to said flat cross-shaped member (8) with upper edge unattached, a slit (20) at center of said leg pocket member (15), a central opening (16) to accommodate shoulder-body strap locking device, a storage pocket member (17) having an attachment means to said flat cross-shaped member (8) with lower edge unattached, a storage pocket closure member (19) having an attachment means to said flat cross-shaped member (8) with upper edge and both sides unattached of said storage pocket closure member (19) having an attachment means for storage pocket (18) allowing said storage closure member (19) to engage and disengage with said storage pocket member (17), a filler (21) is used when a double layer of said flat cross-shaped member (8) is employed, no filler (21) if single layer, said flat cross shaped member (8) having an edge (22) typical at all edges with an attachment means for edging (23).

U.S. Pat. No. Des. 300,281

Inventor Fredrics V. Coates

Issued: Mar. 21, 1989

This United States Patent discloses an ornamental design for a combination bib with pacifier holder, as illustrated in the drawing of the patent.

While these swaddling and/or pacifier holding devices designed for infant use may be suitable for the purposes for which they were designed, they would not be as suitable for the purposes of the present invention, as hereinafter described.

SUMMARY OF THE PRESENT INVENTION

The present invention discloses a method and apparatus for holding a pacifier within a pacifier holder. In one embodiment the pacifier is internally secured by means in a rolled quilt holder with the nipple projecting from the rolled holder having a means for securing the holder. Additionally, methods are described for wrapping an infant in a blanket in such a way as to prevent movement of the arms and legs of the infant so that the infant can properly access the pacifier and holder.

A primary object of the present invention is to provide a method and apparatus for pacifying an infant.

Another object of the present invention is to provide a swaddling blanket for securing an infants appendages from excessive movement.

Yet another object of the present invention is to provide a swaddling blanket having one corner folded and permanently stitched toward the center of the swaddling-like blanket.

Still yet another object of the present invention is to provide a holder for a pacifier to maintain the positioning of said pacifier.

Yet another object of the present invention is to provide a holder for a pacifier having means for selectively securing said pacifier to said holder.

Another object of the present invention is to provide a holder for a pacifier having means for selectively securing said pacifier to said holder and said holder can be rolled into a support for said pacifier having means for holding the rolled state of the holder.

Additional objects of the present invention will appear as the description proceeds.

The present invention overcomes the shortcomings of the prior art by providing a method and apparatus for soothing an infant comprising a pacifier, pacifier holder and swaddling blanket. The pacifier is internally secured with the nipple projecting from a rolled quilt having securement means for selectively attaching a pacifier, and hook and loop material providing means for holding the rolled state of the quilt. In addition, a swaddling-like blanket having one corner folded toward the center and permanently stitched is used to provide security for the infant as well as restricting movement of the arms and legs.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
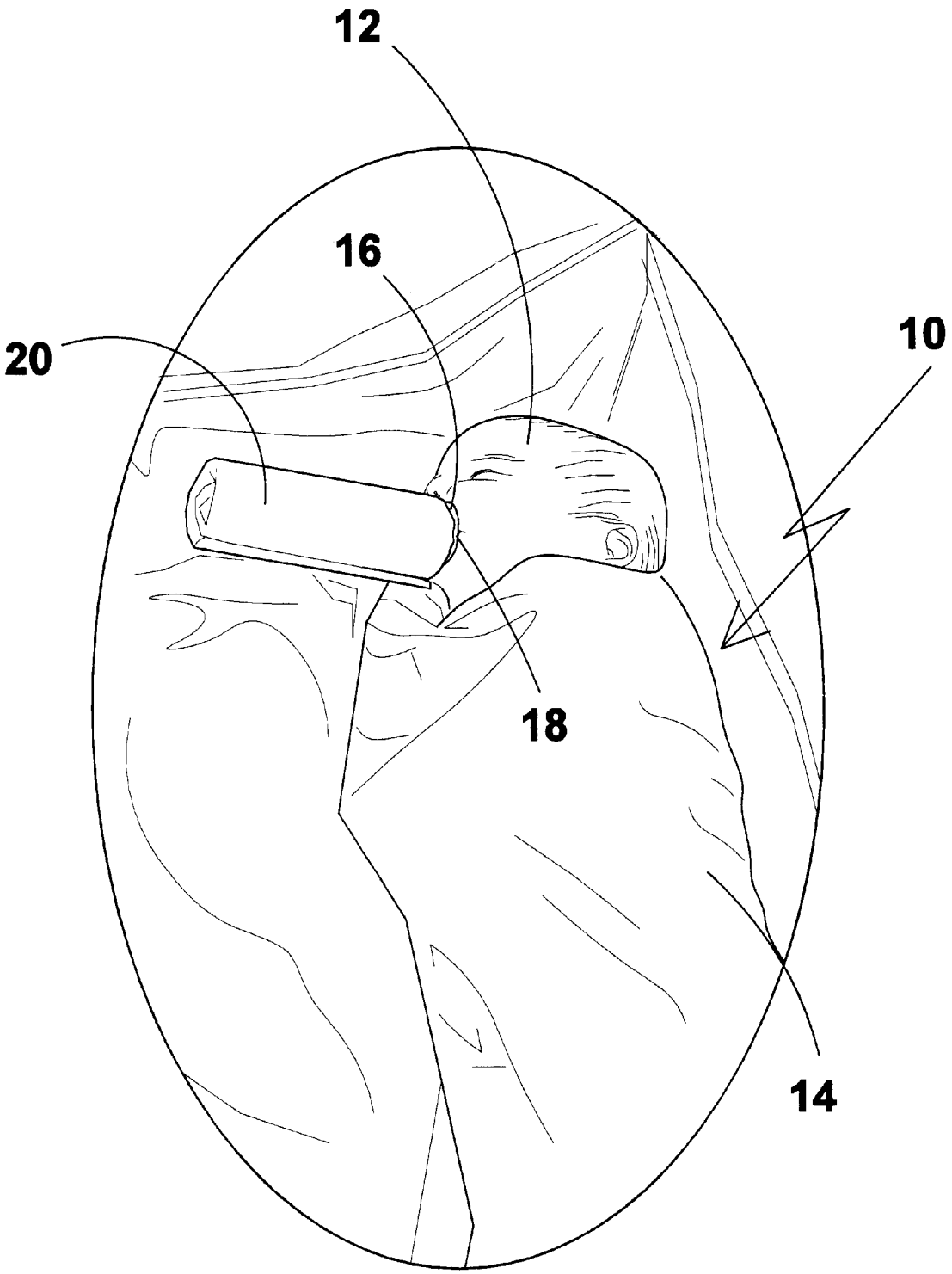
FIG. 1 is perspective view of the present invention in use. Shown is an infant having been wrapped in a swaddling blanket and placed in such a position as to prevent rolling. Also shown is a pacifier within the infant's mouth and pacifier support positioned in such a manner as to prevent displacement of the pacifier from the infant's mouth.

With regard to reference numerals used, the following numbering is used throughout the drawings.

10 present invention
12 infant
14 blanket
16 pacifier
18 mouth
20 pacifier support
22 first corner
24 center
26 stitching
28 edge
30 neck
32 first fold line
34 corner
36 first fold
38 second fold line
40 excess
42 third fold line
44 corner
46 feet
48 fourth fold line
50 corner
52 strap
54 pacifier
56 hook and loop material
58 handle
60 direction arrow
62 means for securing
64 nipple

DESCRIPTION OF THE PREFERRED EMBODIMENT(S)

In order that the invention may be more fully understood, it will now be described, by way of example, with reference to the accompanying drawings in which FIGS. 1 through 19 illustrate the present invention being a method and apparatus for pacifying an infant.

Turning to FIG. 1, shown therein is a perspective view of the present invention 10 in use. Shown is an infant 12 having been wrapped in a swaddling blanket 14 and placed in such a position as to prevent rolling. Also shown is a pacifier 16 within the infant's mouth 18 and pacifier support 20 positioned in such a manner as to prevent displacement of the pacifier 16 from the infant's mouth 18.

Figure 2:
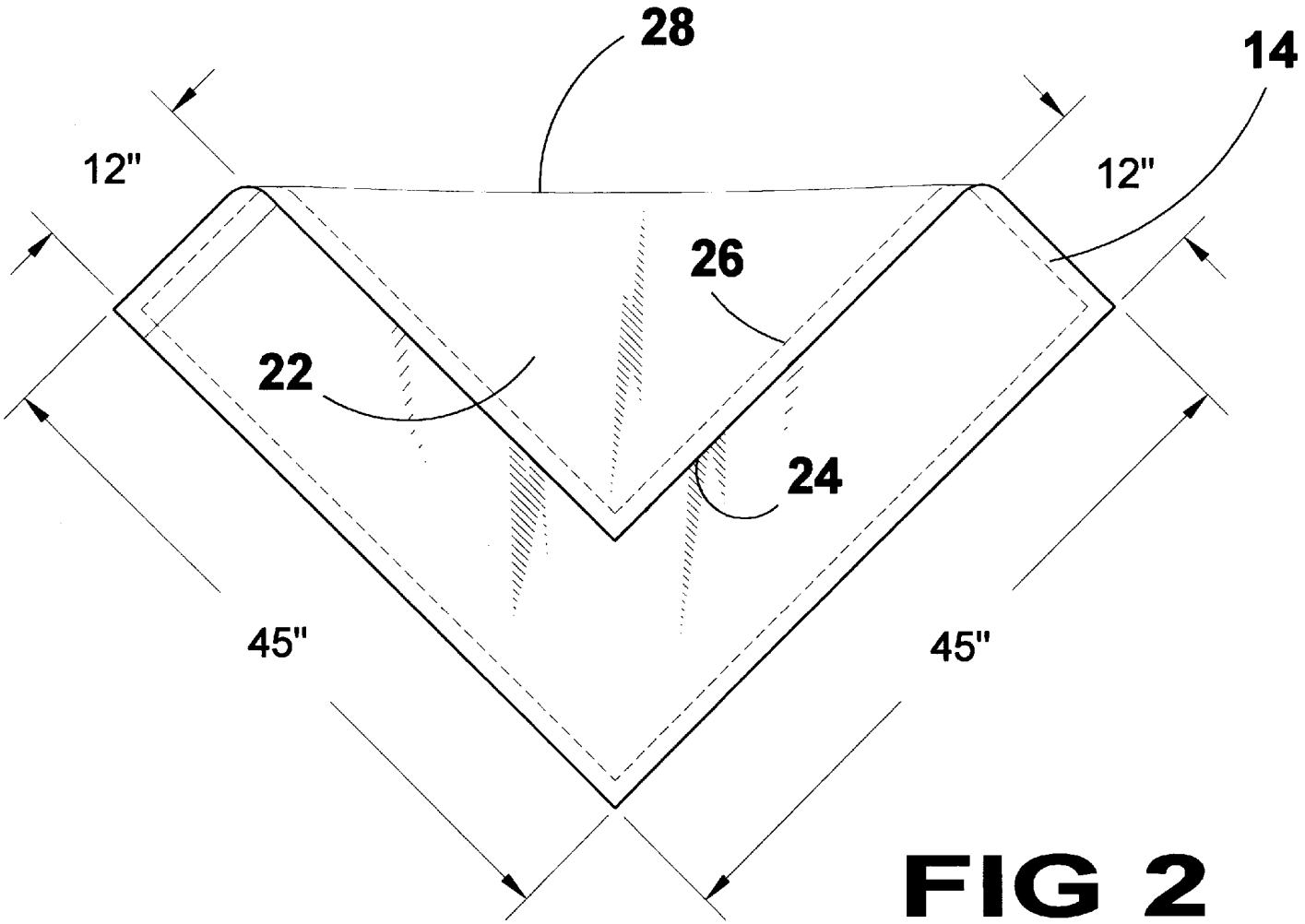
FIG. 2 is a plan view of the swaddling blanket of the present invention. Shown is a blanket having one corner folded toward the center and permanently stitched. The swaddling blanket folded edge will form support for the infant's neck.

Turning to FIG. 2, shown therein is a plan view of the swaddling blanket 14 of the present invention. Shown is a blanket 14 having one corner 22 folded toward the center 24 and permanently stitched 26. The swaddling blanket folded edge 28 will form support for the infant's neck as will be shown hereinafter.

Figure 3:
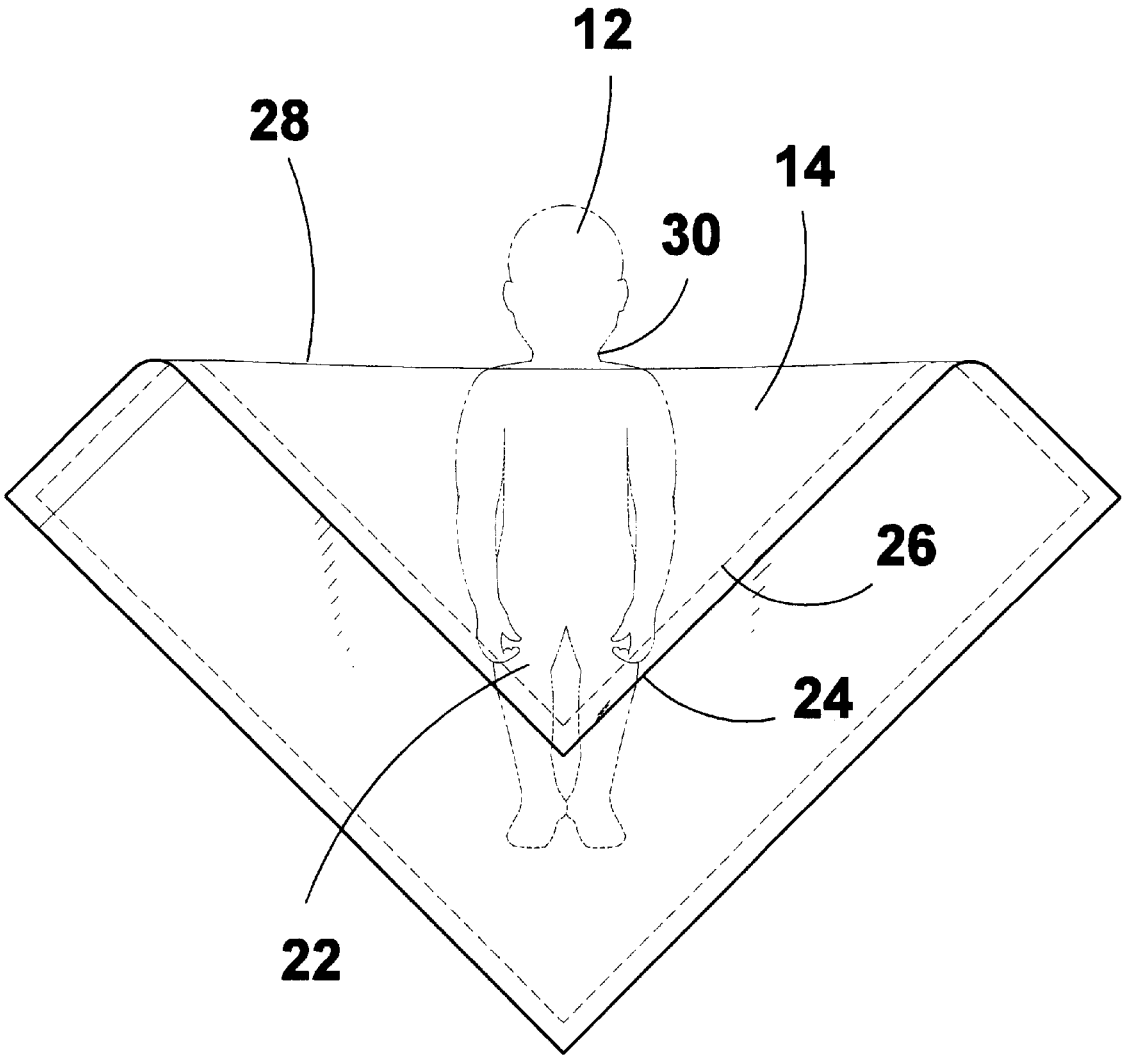
FIG. 3 is an illustrative view of the initial positioning of the infant on the swaddling blanket in preparation for substantially folding said infant within said swaddling blanket.

Turning to FIG. 3, shown therein is an illustrative view of the initial positioning of the infant 12 on the swaddling blanket 14 in preparation for substantially folding the infant 12 within the swaddling blanket 14. Edge 28 is shown near the neck 30 of infant 12 for supporting the neck. Other features previously disclosed are also shown.

Figure 4:
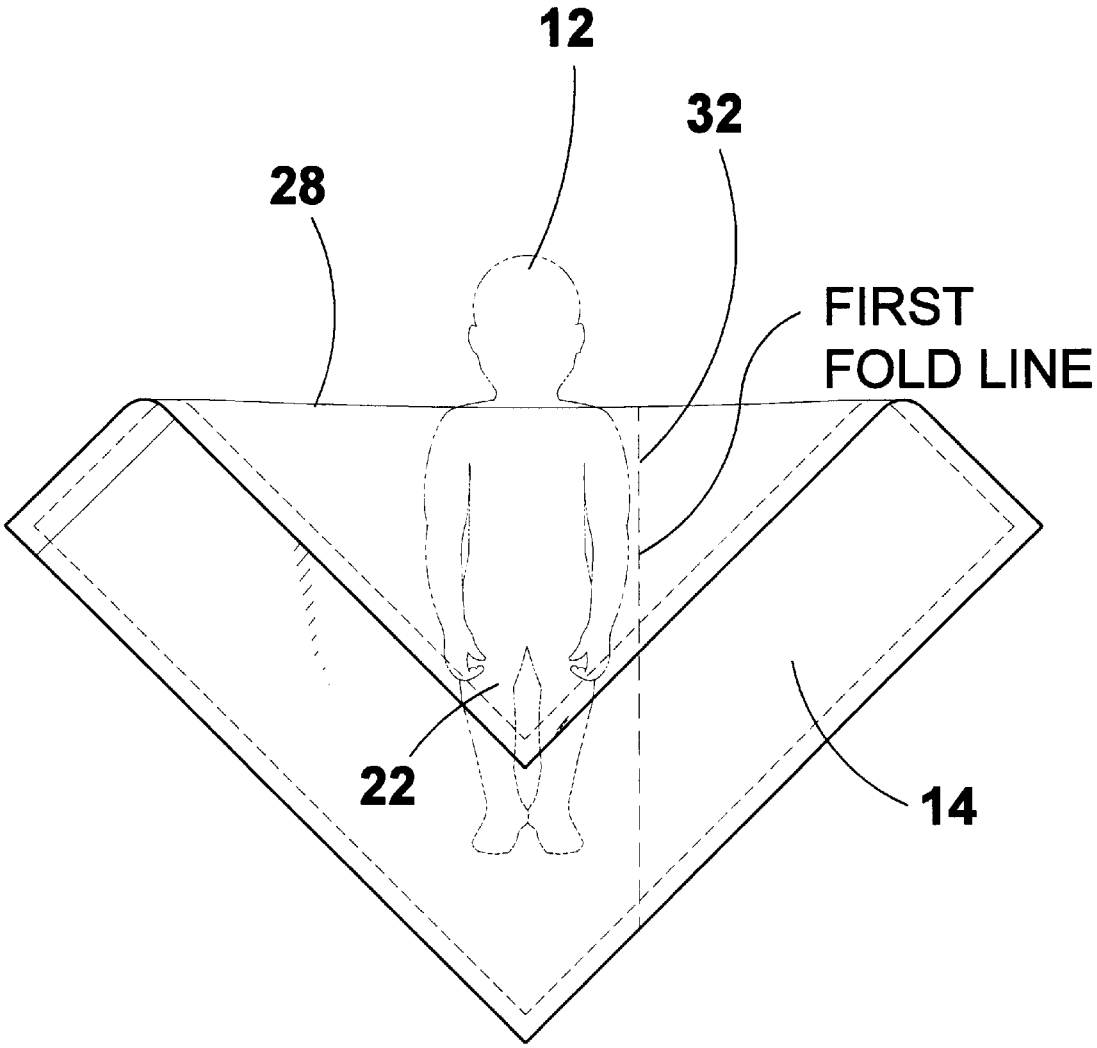
FIG. 4 is an illustrative view of the infant positioned on the swaddling blanket with the first fold line shown in outline.

Turning to FIG. 4, shown therein is an illustrative view of the infant 12 positioned on the swaddling blanket 14 with the first fold line 32 shown in outline parallel to the longitudinal axis of infant 12. Other features previously disclosed are also shown.

Figure 5:
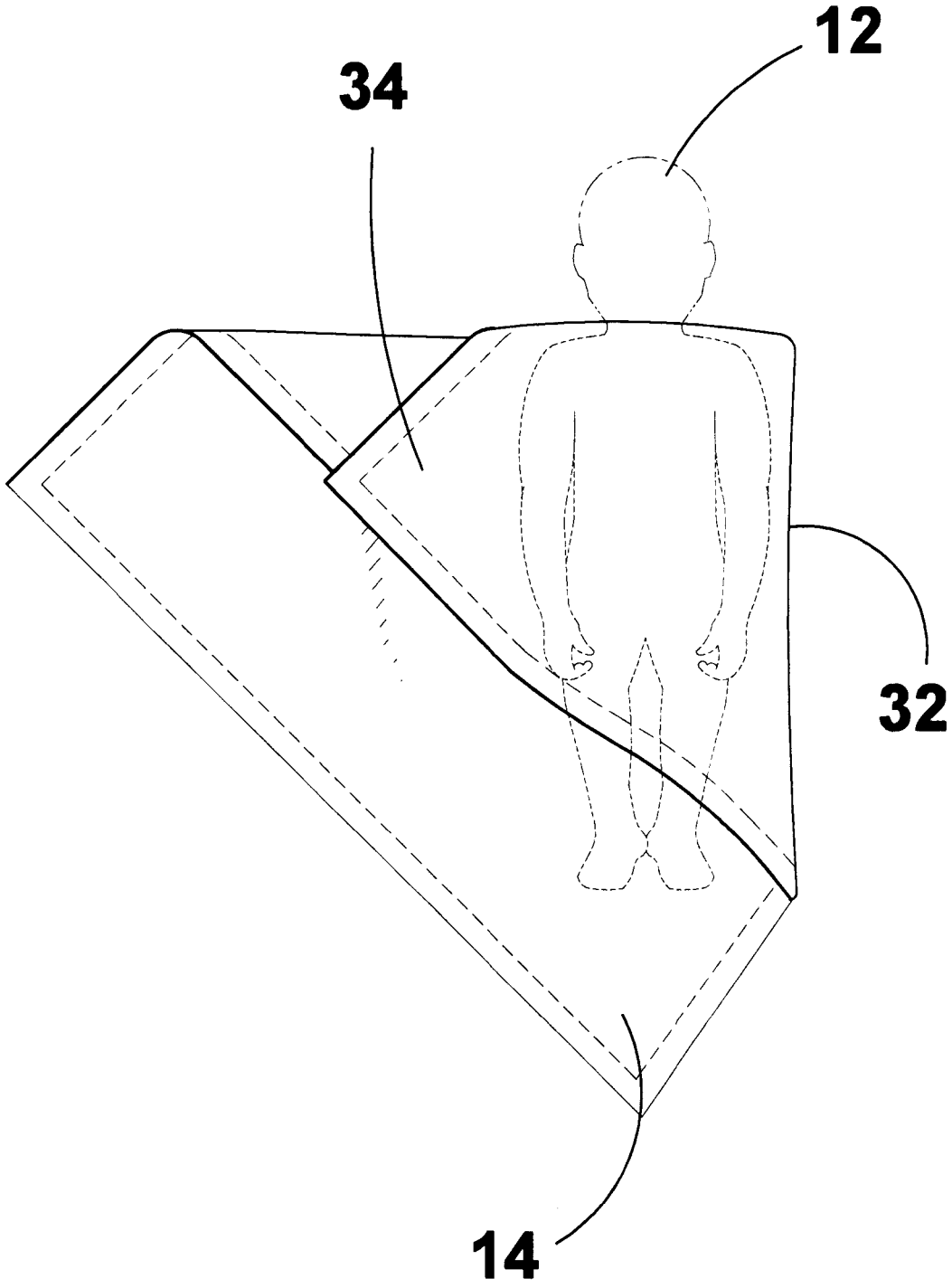
FIG. 5 is an illustrative view of the infant positioned on the swaddling blanket having an adjacent corner folded across the infant according to the first fold line as indicated in FIG. 4.

Turning to FIG. 5, shown therein is an illustrative view of the infant 12 positioned on the swaddling blanket 14 having an adjacent corner 34 folded across the infant 12 according to the first fold line 32 as indicated in FIG. 4.

Figure 6:
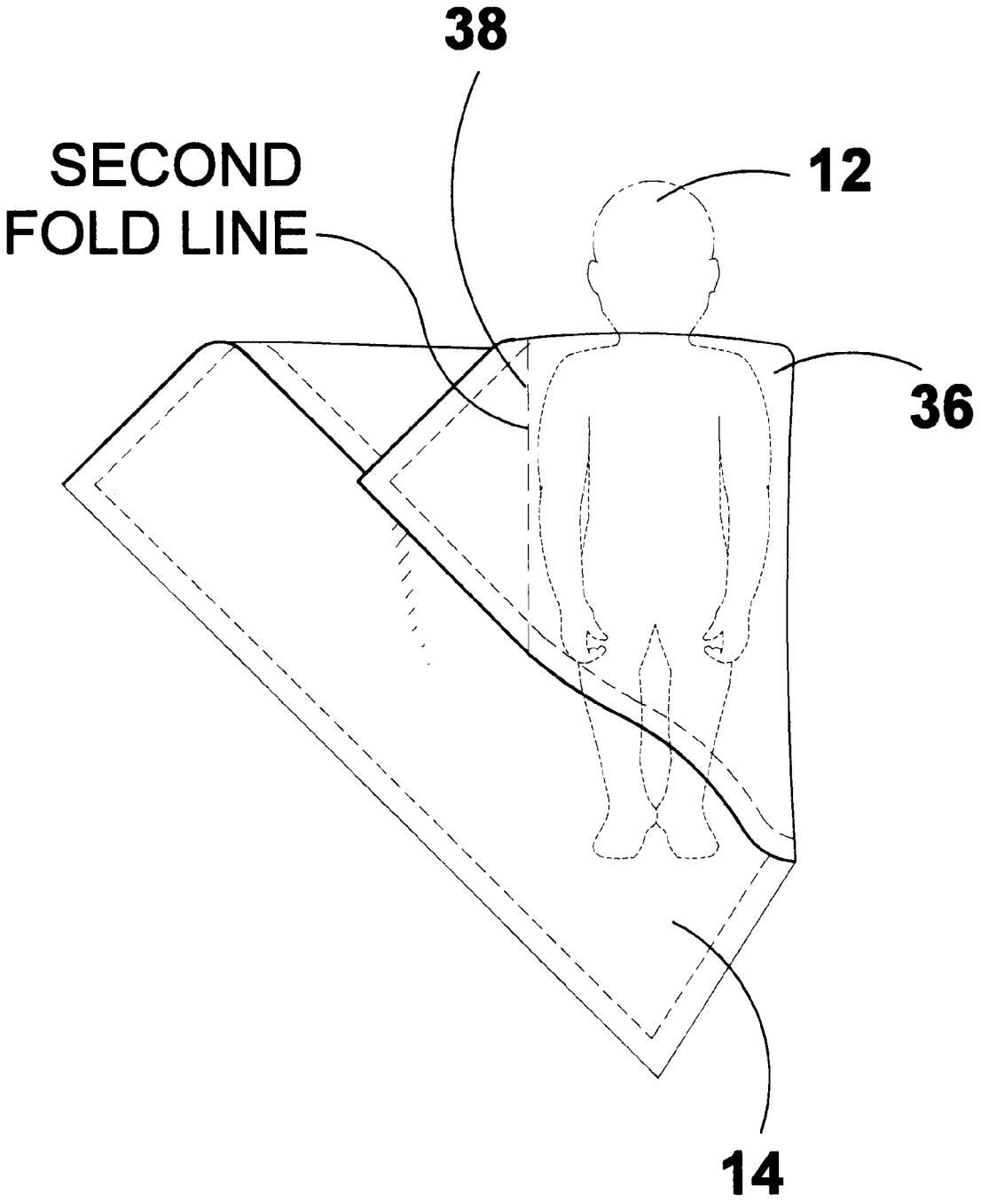
FIG. 6 is an illustrative view of the infant positioned within the first fold of the swaddling blanket with the second fold line shown in outline.

Turning to FIG. 6, shown therein is an illustrative view of the infant 12 positioned within the first fold 36 of the swaddling blanket 14 with the second fold line 38 shown in outline parallel to the longitudinal axis of infant 12.

Figure 7:
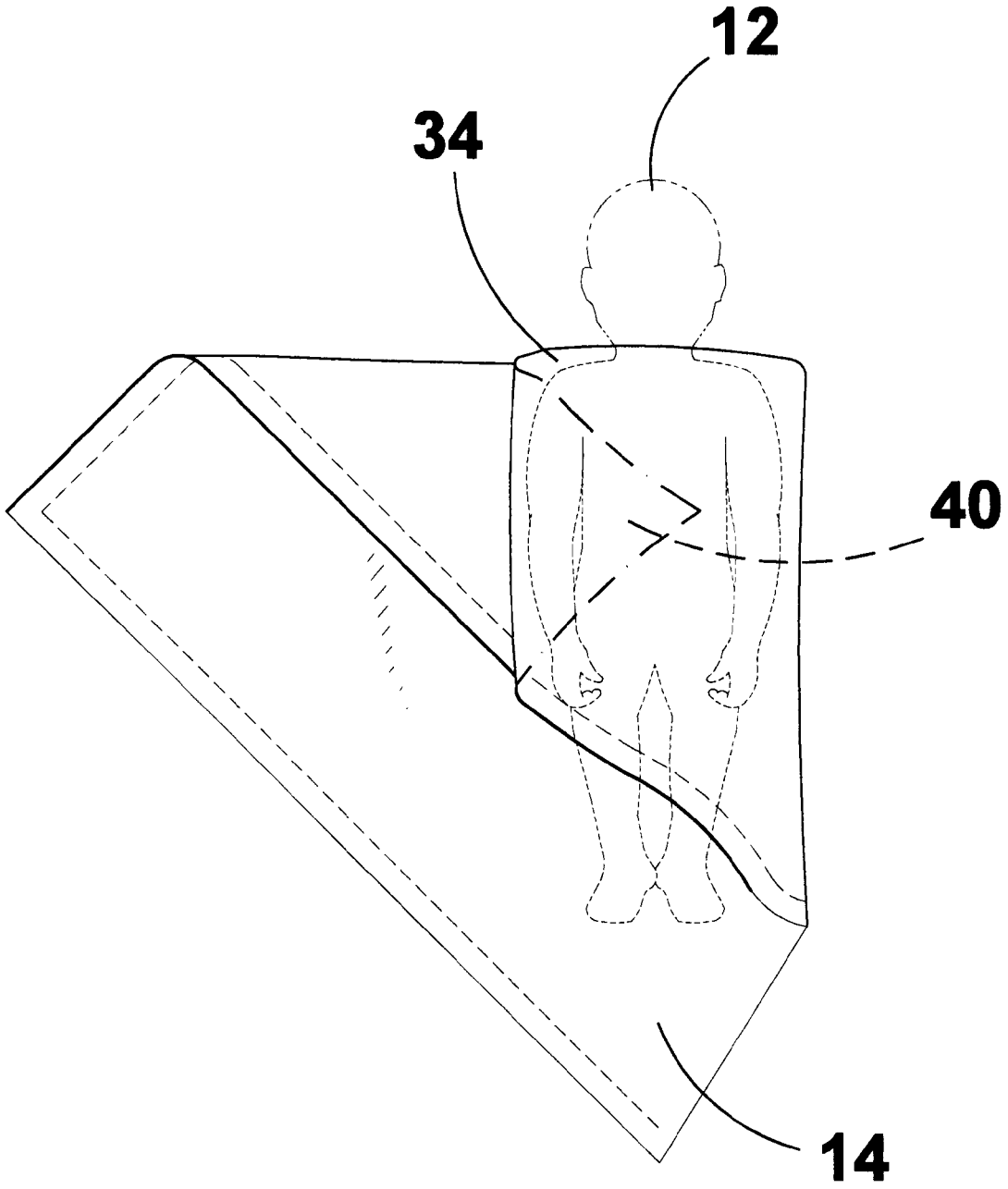
FIG. 7 is an illustrative view of the infant positioned within the swaddling blanket having the excess of the previously folded corner folded back across the infant according to the second fold line as indicated in FIG. 6.

Turning to FIG. 7, shown therein is an illustrative view of the infant 12 positioned within the swaddling blanket 14 having the excess 40 of the previously folded corner 34 folded behind the infant 12 according to the second fold line 38 as indicated in FIG. 6.

Figure 8:
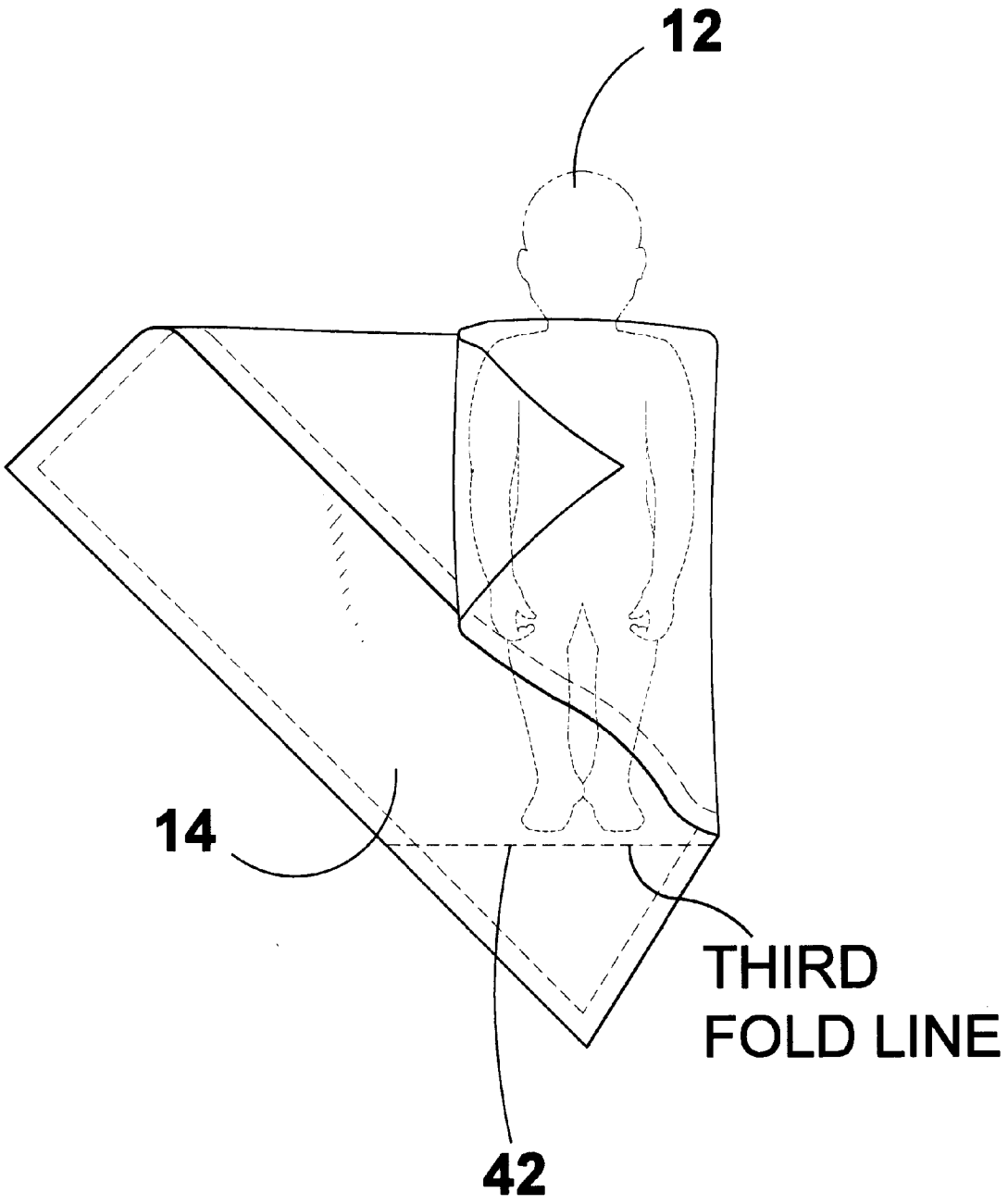
FIG. 8 is an illustrative view of the infant positioned within the swaddling blanket with the third fold line shown in outline.

Turning to FIG. 8, shown therein is an illustrative view of the infant 12 positioned within the swaddling blanket 14 with the third fold line 42 shown in outline perpendicular to the longitudinal axis of infant 12.

Figure 9:
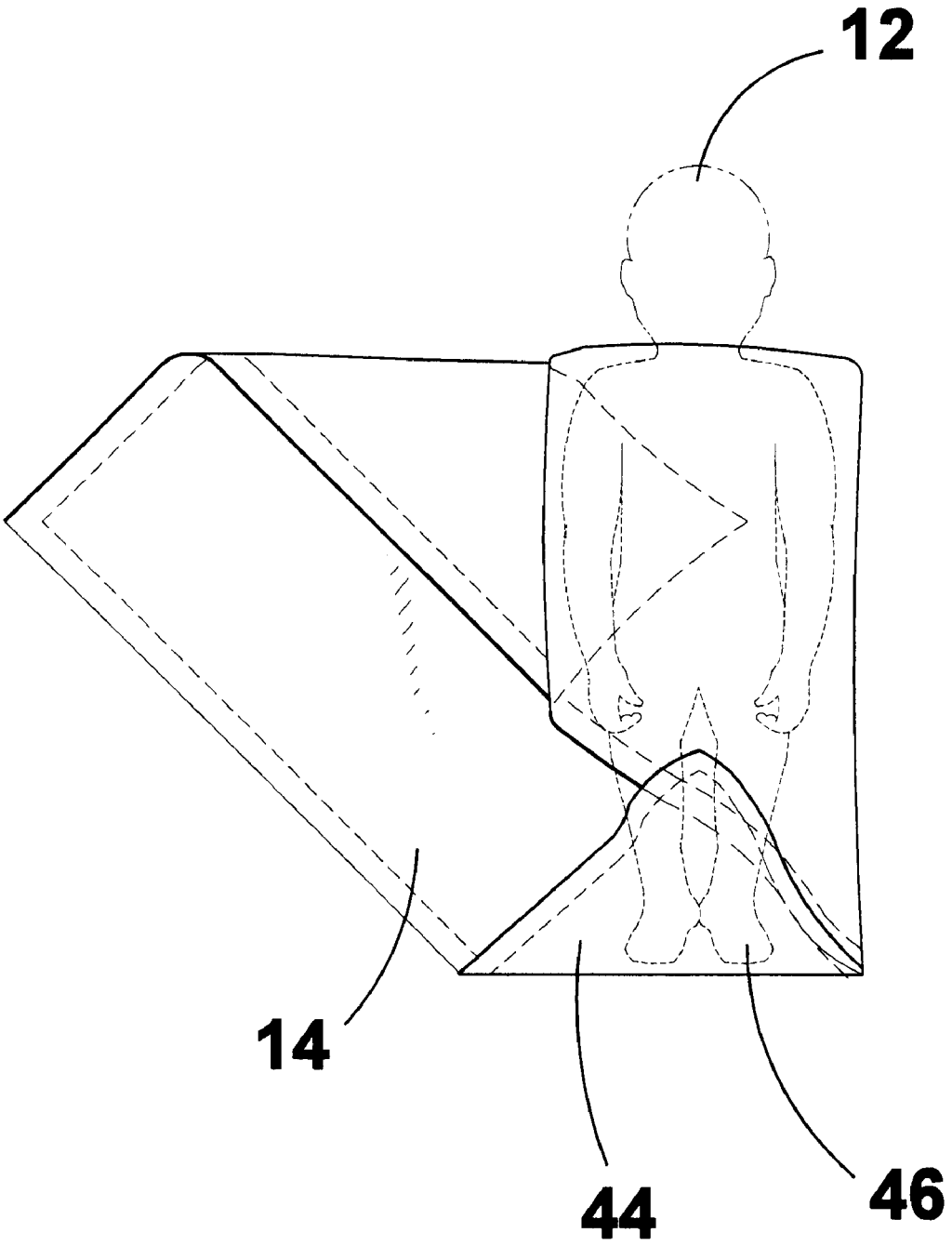
FIG. 9 is an illustrative view of the infant positioned within the swaddling blanket having the corner folded up over the infant's feet according to the third fold line as indicated in FIG. 8.

Turning to FIG. 9, shown therein is an illustrative view of the infant 12 positioned within the swaddling blanket 14 having the corner 44 folded up over the infant's feet 46 according to the third fold line as indicated in FIG. 8.

Figure 10:
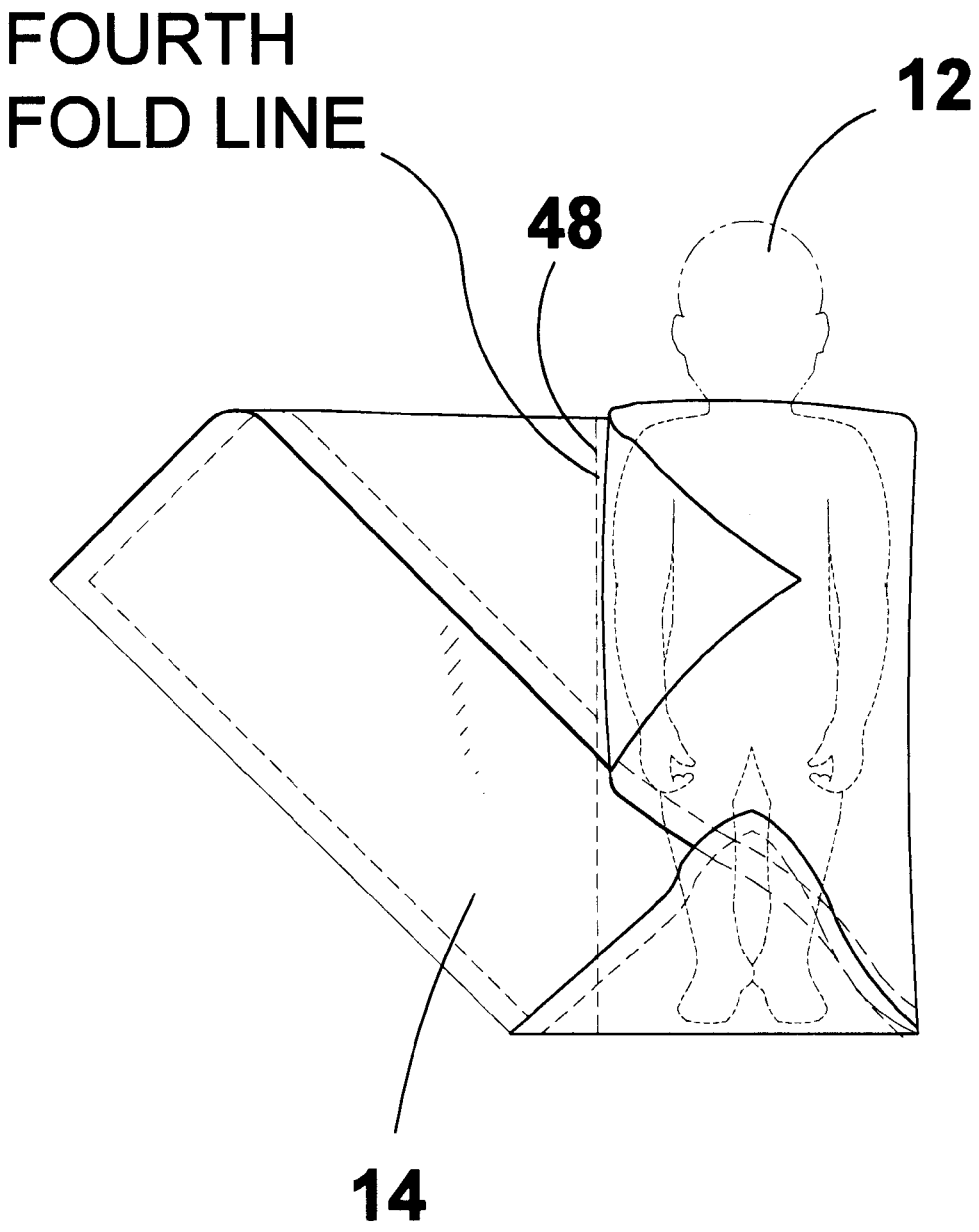
FIG. 10 is an illustrative view of the infant positioned within the swaddling blanket with the fourth fold line shown in outline.

Turning to FIG. 10, shown therein is an illustrative view of the infant 12 positioned within the swaddling blanket 14 with the fourth fold line 48 shown in outline parallel to the longitudinal axis of infant 12.

Figure 11:
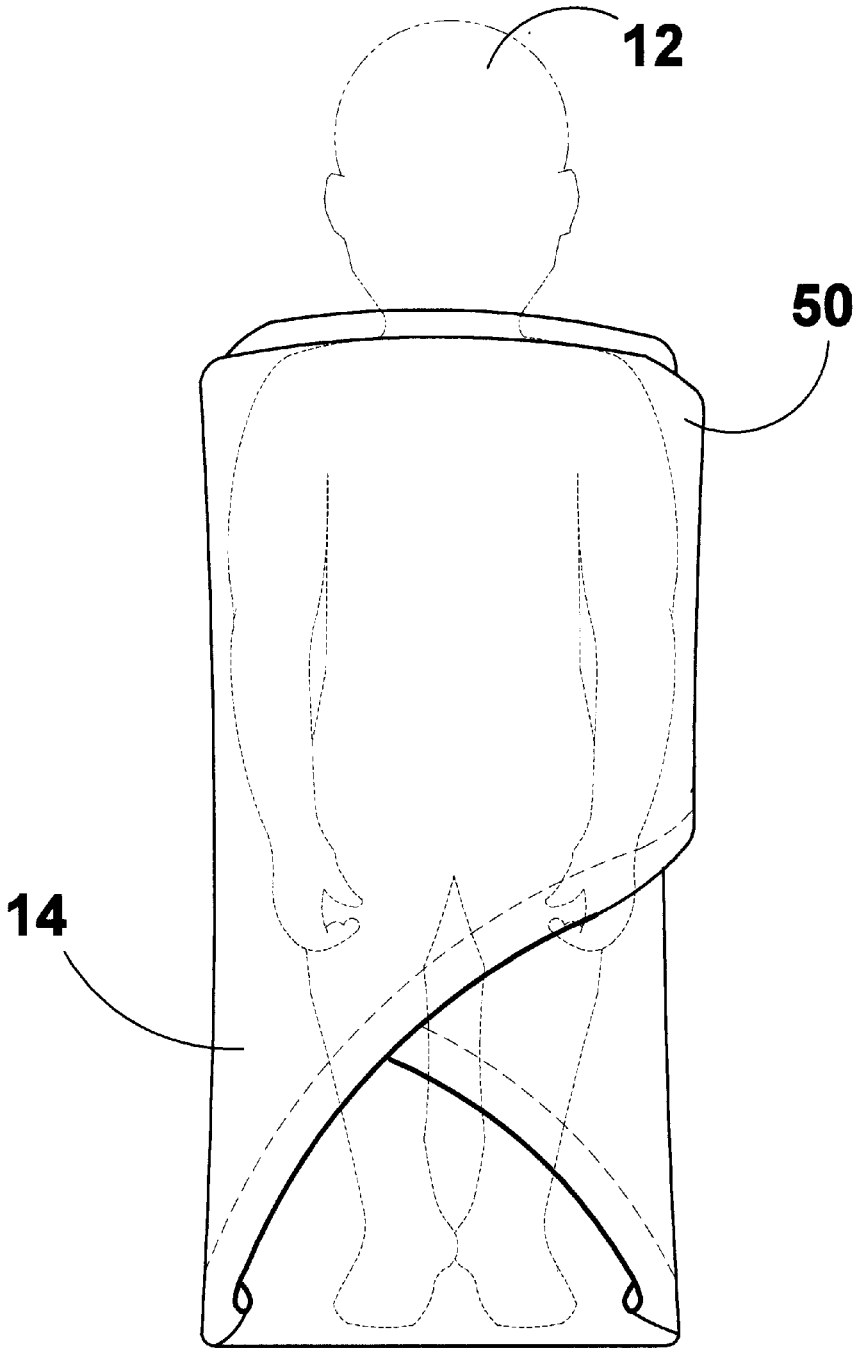
FIG. 11 is an illustrative view of the infant positioned within the swaddling blanket having the other adjacent corner folded over the infant's body according to the fourth and final fold line as indicated in FIG. 10.

Turning to FIG. 11, shown therein is an illustrative view of the infant 12 positioned within the swaddling blanket 14 having the other adjacent corner 50 folded over the infant's body according to the fourth and final fold line as indicated in FIG. 10.

Figure 12:
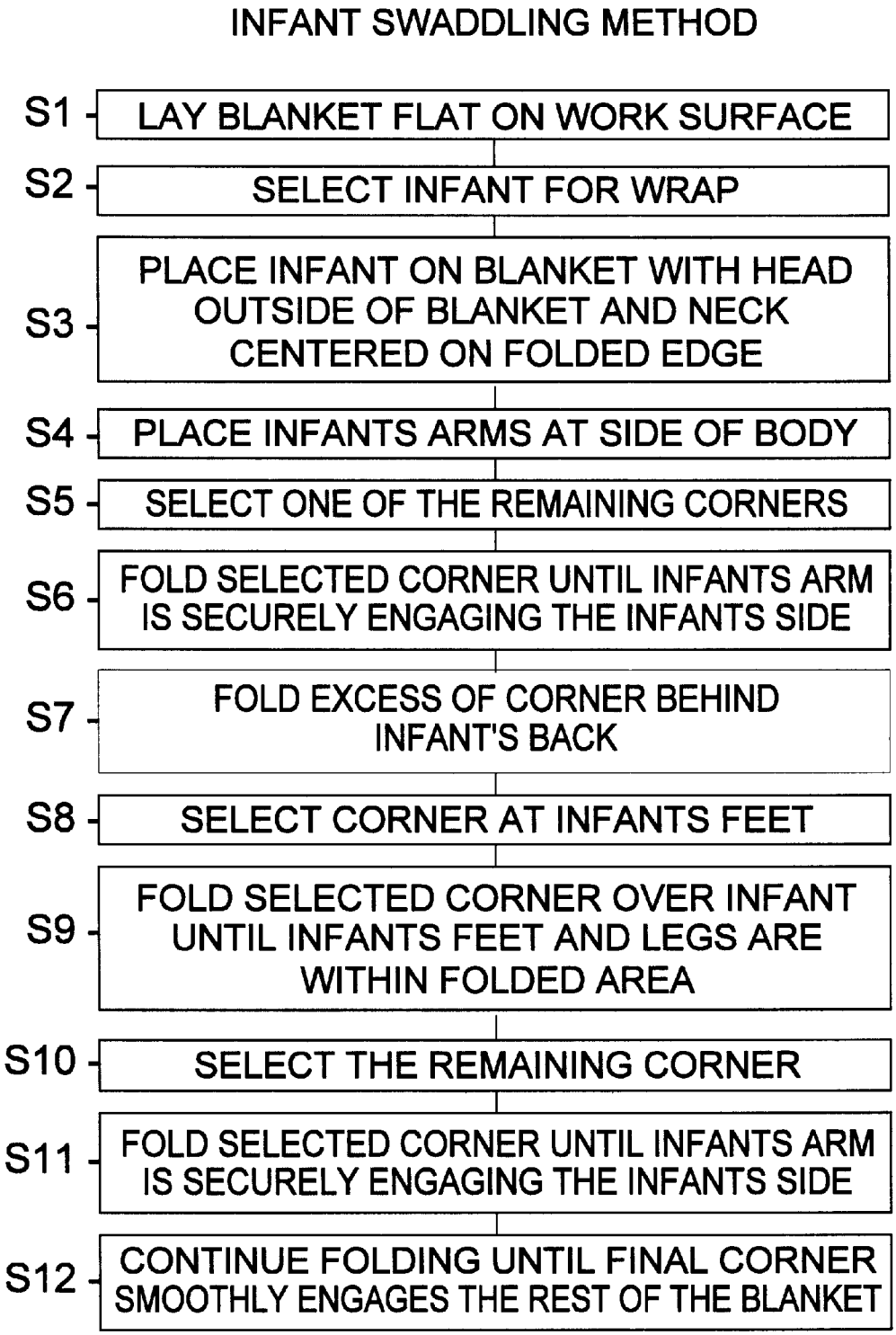
FIG. 12 is a block diagram showing the method of tie present invention for swaddling an infant.

Turning to FIG. 12, shown therein is a block diagram showing the method of the present invention for swaddling an infant. The method comprises the following steps: lay the blanket 14 flat on a work surface; select infant 12 for wrapping; place infant 12 on blanket 14 with head outside of blanket 14 and neck 30 centered on folded edge 28; place infant's 12 arms at side of body; select one of the remaining corners 34; fold selected corner 34 until infant's 12 arm is securely engaging the infant's side; fold excess 40 of corner 34 back across infant's 12 body until fold is clear of infant's side; select corner 44 at infant's feet 46; fold selected corner 44 over infant until infant's feet 46 and legs are within folded area; select the remaining corner 50; fold selected corner 50 until infant's 12 arm is securely engaging the infant's side; continue folding until final corner 50 smoothly engages the rest of the blanket 14.

Figure 13:
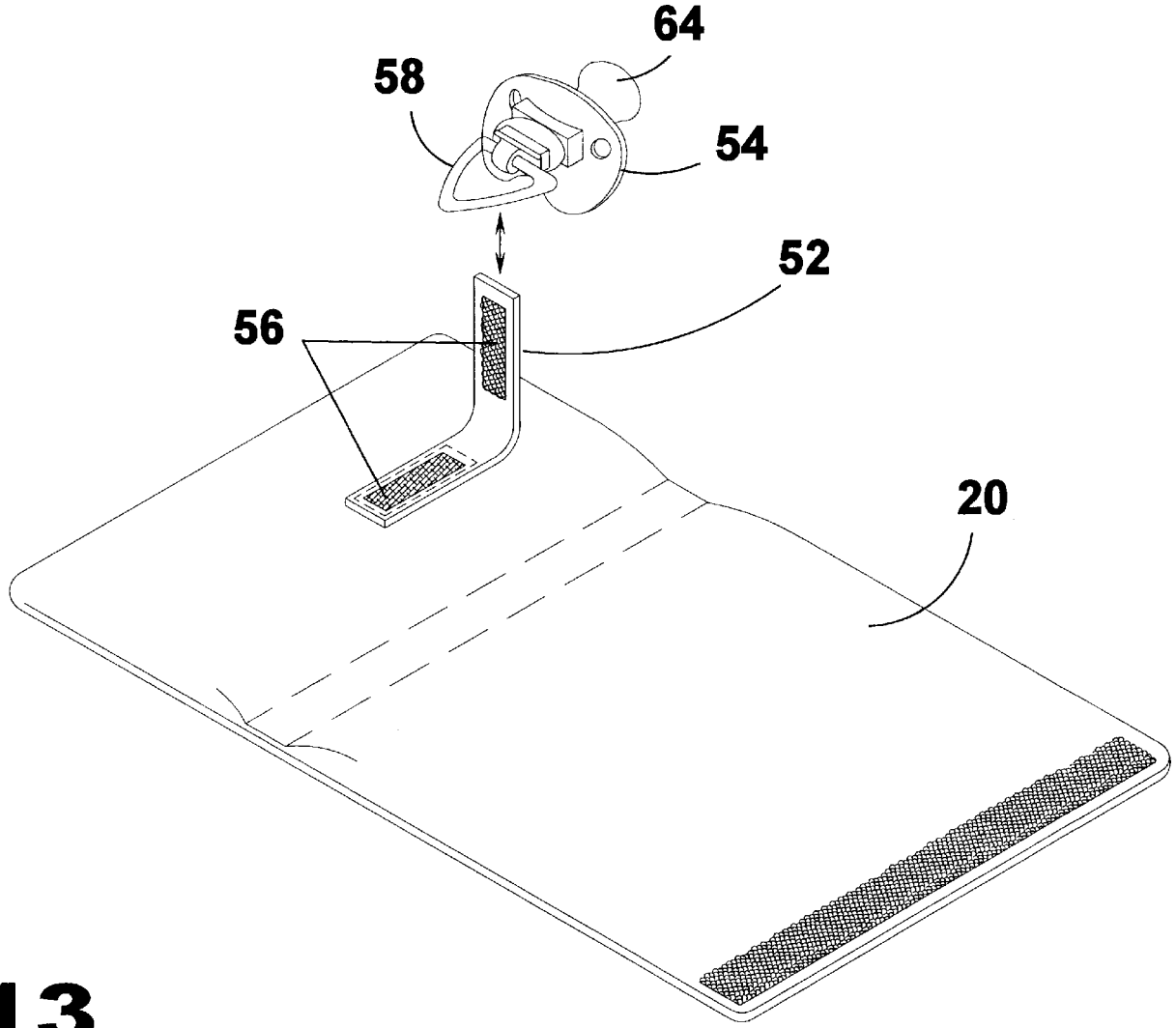
FIG. 13 is a perspective view of the pacifier holder having a strap affixed at one end to the pacifier holder having mating hook and loop material affixed on one side to each end of said strap. Also shown is a typical pacifier ready to be coupled with the pacifier holder by means the pacifier holder strap.

Turning to FIG. 13, shown therein is a perspective view of the pacifier support or holder 20 having a strap 52 affixed at one end to the pacifier holder 20 having mating hook and loop material 56 affixed on one side to each end of the strap. Also shown is a typical pacifier 54 with nipple 64 and handle 58 ready to be attached to the pacifier holder 20 by means the pacifier holder strap 52.

Figure 14:
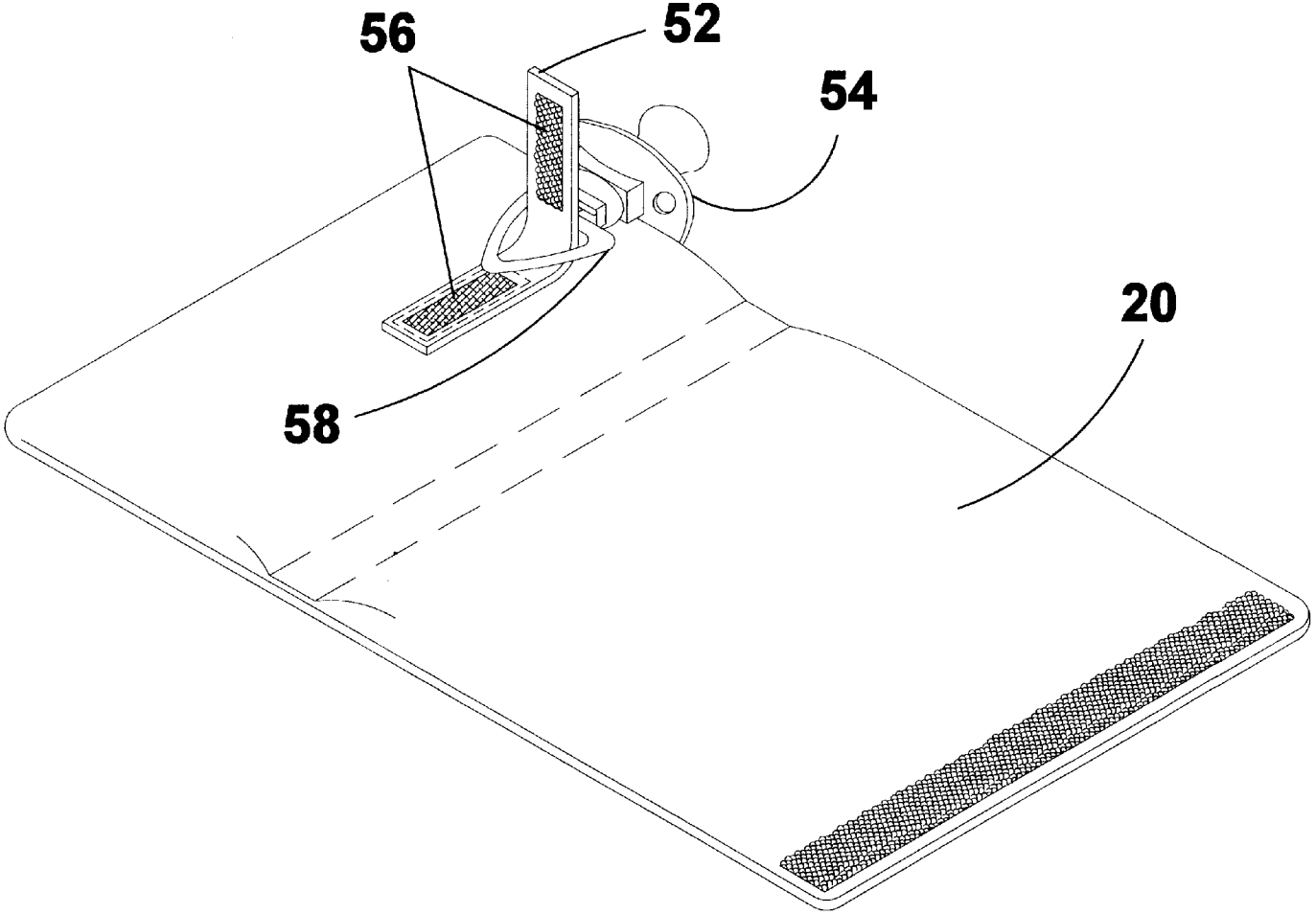
FIG. 14 is a perspective view of the pacifier holder having a strap affixed at one end to the pacifier holder having mating hook and loop material affixed on one side to each end of said strap. Also shown is a typical pacifier having the handle of said pacifier inserted onto said pacifier holder strap.

Turning to FIG. 14, shown therein is a perspective view of the pacifier holder 20 having a strap 52 affixed at one side or end of the pacifier holder 20 having mating hook and loop material 56 affixed on one side to each end of the strap 52. Also shown is a typical pacifier 54 having the handle 58 of the pacifier 54 inserted onto the pacifier holder strap 52.

Figure 15:
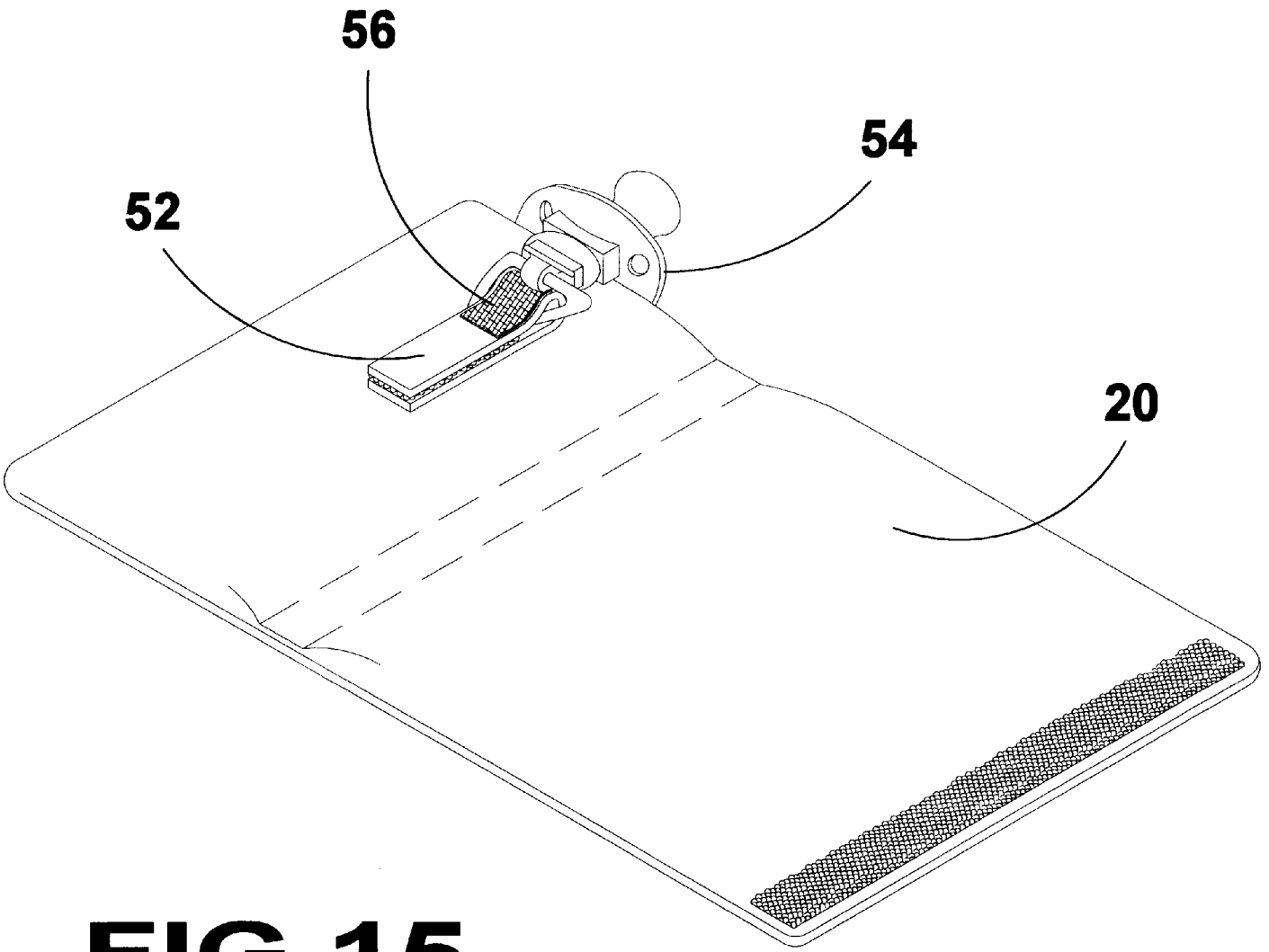
FIG. 15 is a perspective view of the pacifier holder having a pacifier selectively attached by means of the pacifier holder strap. Also shown is means for holding a pacifier which does not have a handle. Wherein a pacifier without a handle will have a piece of hook and loop material attached to the pacifier which will be attached to a mating piece of hook and loop material located on the facing side of the closed loop.

Turning to FIG. 15, shown therein is a perspective view of the pacifier holder 20 having a pacifier 54 selectively attached by means of the pacifier holder strap 52. Also shown is means 56 for holding a pacifier 54 which does not have a handle wherein a pacifier 54 without a handle will have a piece of mating hook and loop material attached to the pacifier 54 which will be attached to a mating piece of hook and loop material 56 located on the facing side of the closed loop formed by strap 52.

Figure 16:
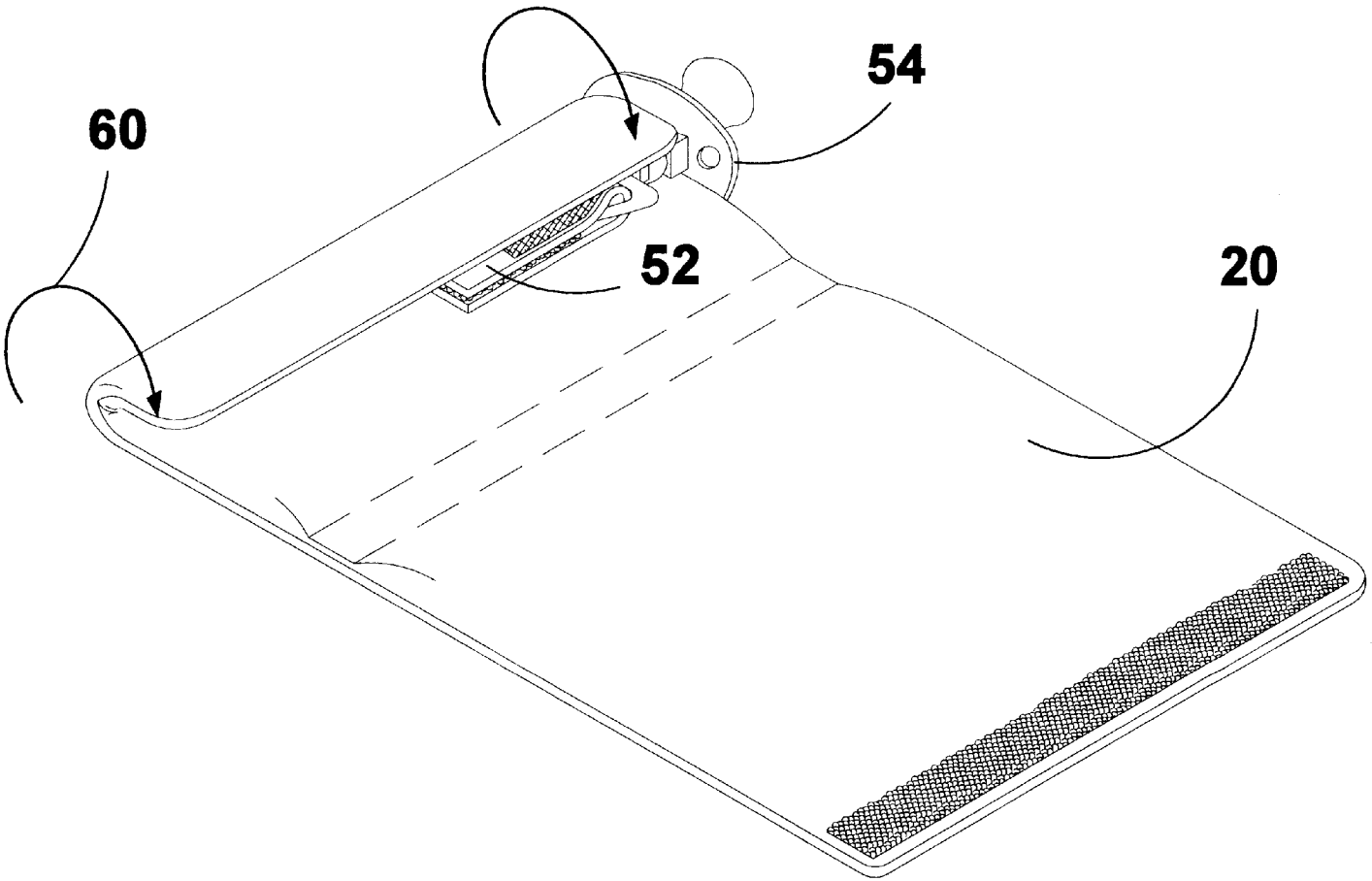
FIG. 16 is a perspective view of the pacifier holder showing the pacifier holder being rolled into a support structure for the pacifier which has been attached to the pacifier holder by means of the pacifier holder strap.

Turning to FIG. 16, shown therein is a perspective view of the pacifier holder 20 showing the pacifier holder 20 being rolled according to direction arrows 60 into a support structure for the pacifier 54 which has been attached to the pacifier holder 20 by means of the pacifier holder strap 52.

Figure 17:
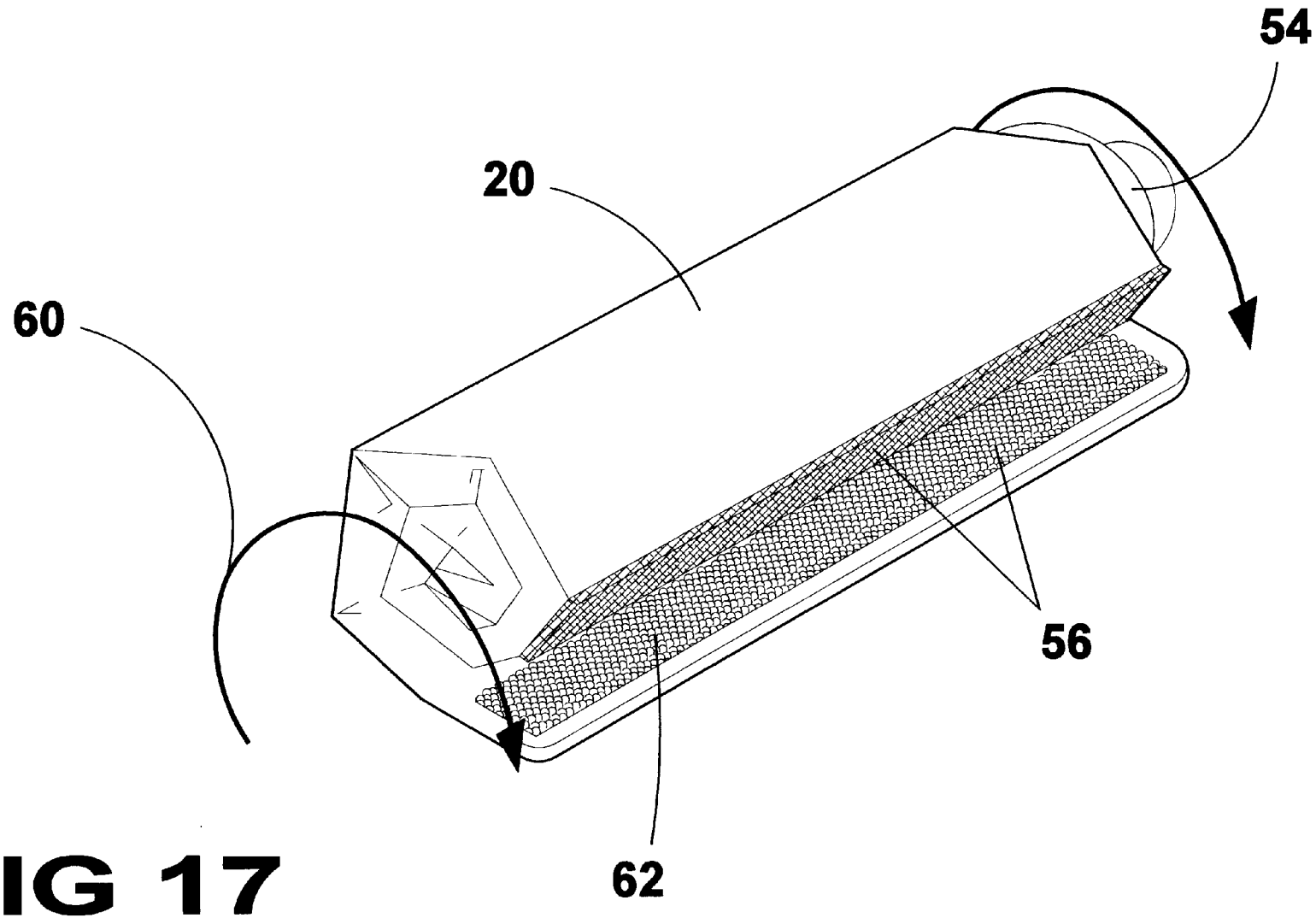
FIG. 17 is a perspective view of the pacifier holder showing the pacifier holder rolled into a support structure, having means for securing said rolled structure, for the pacifier which is enclosed therein by means of the pacifier holder strap.

Turning to FIG. 17, shown therein is a perspective view of the pacifier holder 20 showing the pacifier holder rolled according to arrows 60 into a support structure, having means 62 for securing, e.g., using mating hook and loop material 56, the rolled structure for the pacifier 54 which is enclosed therein by means of the pacifier holder strap.

Figure 18:
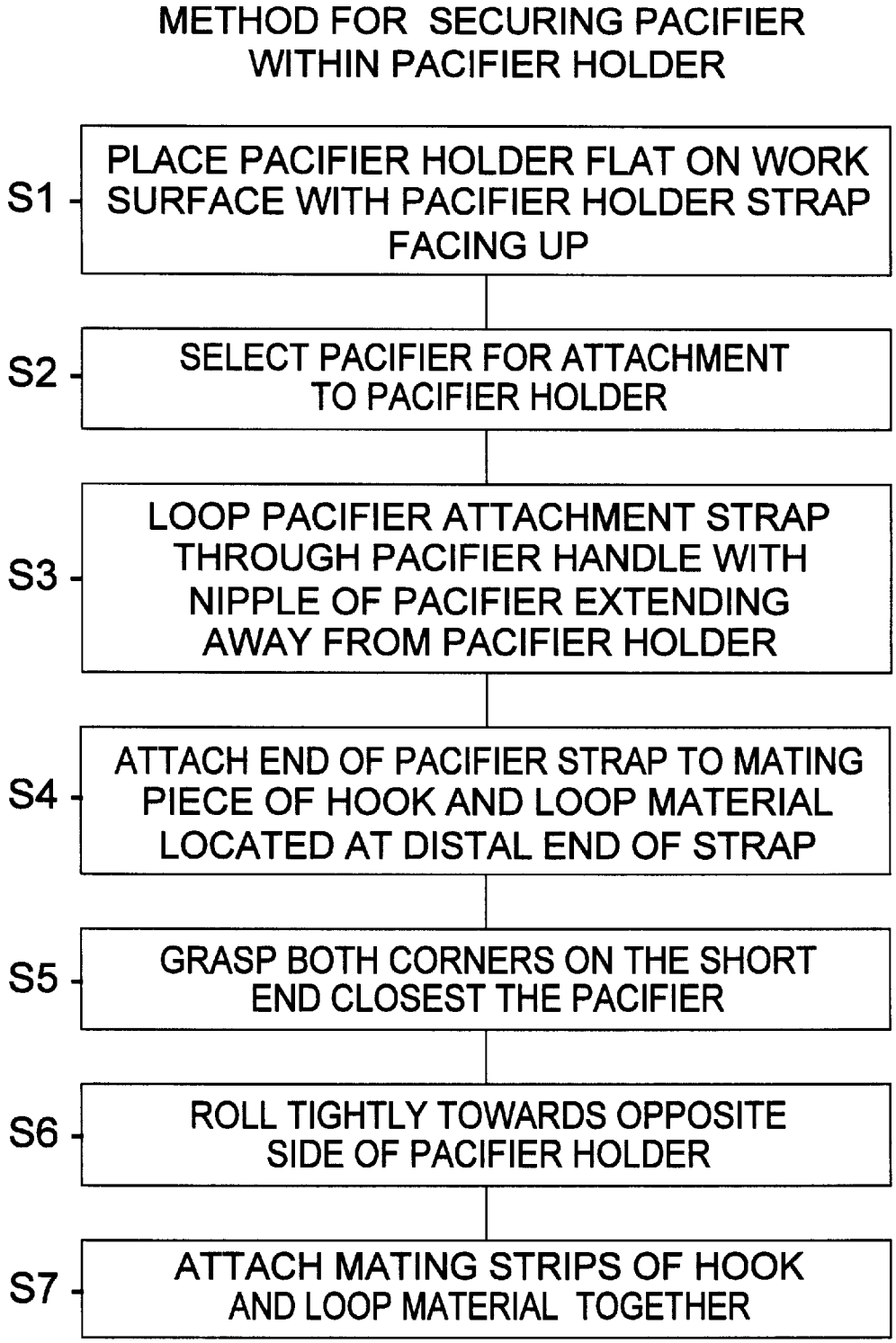
FIG. 18 is a block diagram showing the method of the present invention for securing pacifier within pacifier holder.

Turning to FIG. 18, shown therein is a block diagram showing the method of the present invention for securing the pacifier within the pacifier holder. The method comprises the following steps: place pacifier holder 20 flat on work surface with one end of pacifier holder strap 52 facing up; select pacifier 54 for attachment to pacifier holder 20; loop pacifier 54 attachment strap 52 through pacifier handle 58 with nipple 64 of pacifier extending away from pacifier holder 20; attach end of pacifier strap 52 to mating piece of hook and loop material 56 located at distal end of strap; grasp both corners of holder 20 on the short end closest to the pacifier 54; roll tightly towards opposite side of pacifier holder 20; attach mating strips of hook and loop material 62, 56 together to secure holder 20.

Figure 19:
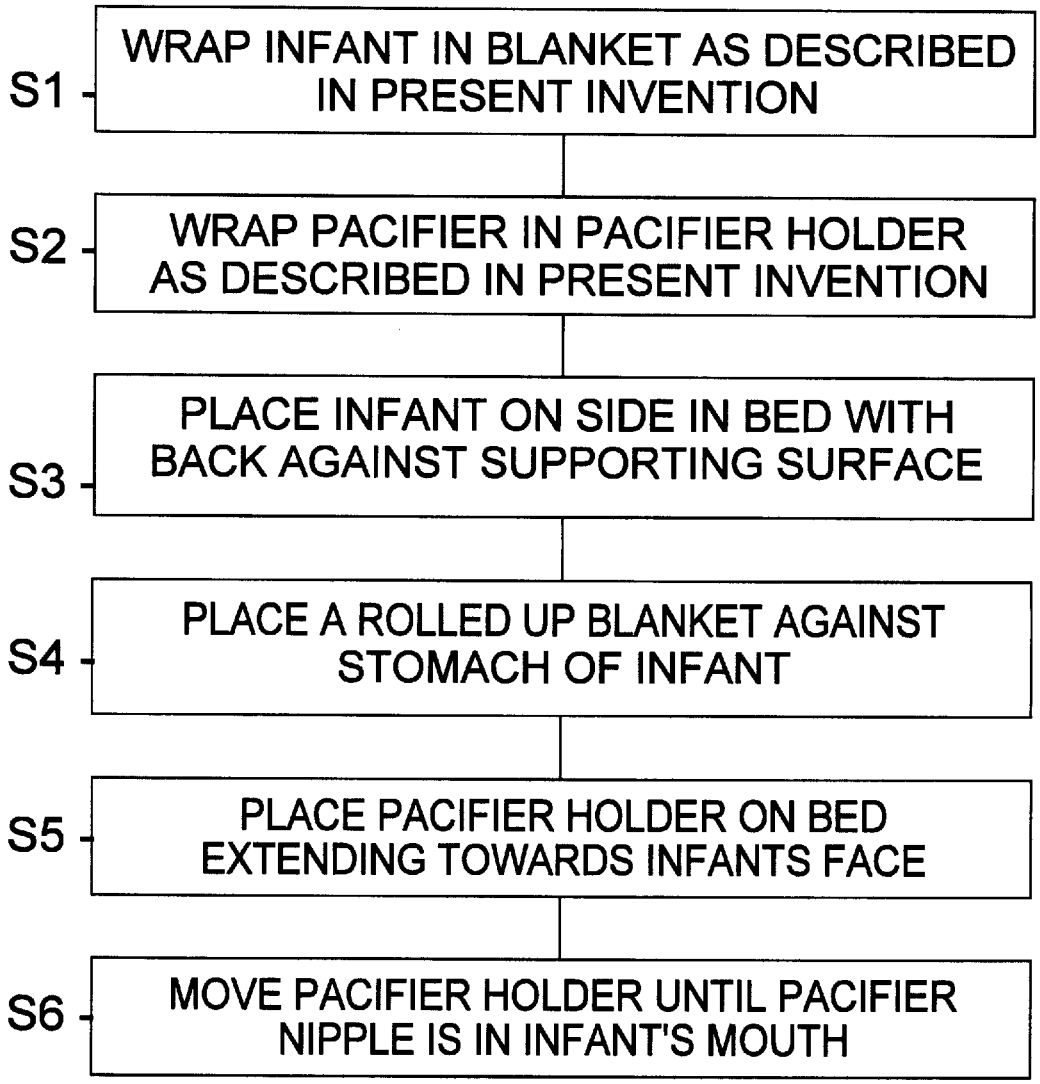
FIG. 19 is a block diagram showing the method of the present invention for extended pacification of infants.

Turning to FIG. 19, shown therein is a block diagram showing the method of the present invention for extended pacification of infants. The method comprises the following steps: wrap infant 12 in blanket 14 as previously described in present invention; wrap pacifier 54 in pacifier holder 20 as previously described in present invention; place infant 12 on its side in bed with back against supporting surface; place a rolled up blanket 14 against stomach of infant 12; place pacifier holder 20 on bed extending towards infant's 12 face; move pacifier holder 20 toward infant 12 until pacifier nipple 64 is in infant's mouth 18.

What is claimed to be new and desired to be protected by Letters Patent is set forth in the appended claims:

1. A method for swaddling an infant, comprising the steps of:

a) placing a generally square blanket having a center and first, second, third and fourth corners on a flat work surface;

b) selecting an infant for wrapping;

c) folding the first corner of said blanket toward the center of said blanket;

d) placing said infant on said blanket with the head of said infant outside of said blanket with the neck of said infant centered on a folded edge of said first corner;

e) placing arms of said infant at sides of its body;

f) selecting the second corner of said blanket adjacent said infant;

g) folding said second corner across said infant until one arm of said infant is securely pressed against a side of said infant by said blanket;

h) folding an excess of said second corner extending beyond said infant back across the body of said infant;

i) selecting the third corner of said blanket positioned at the feet of said infant;

j) folding said third corner over the feet and legs of said infant;

k) selecting the fourth remaining corner;

l) folding said fourth corner until an arm of said infant is securely pressed against a side of said infant by said blanket; and, m) continuing folding of said fourth corner until all of said fourth corner engages said blanket.

2. A method of securing a pacifier within a pacifier holder, comprising the steps of:

a) placing a generally rectangular pacifier holder on a flat work surface with a pacifier attachment strap positioned upwardly;

b) selecting a pacifier having a hollow pacifier handle for attachment to the pacifier holder;

c) looping the pacifier attachment strap through the pacifier handle with a nipple of the pacifier extending away from the pacifier holder;

d) attaching a proximate end of the pacifier strap to a mating piece of hook and loop material located at a distal end of the strap;

e) grasping corners on an end of the pacifier holder nearest the pacifier;

f) rolling the pacifier holder tightly towards an opposite side of the pacifier holder; and, g) attaching mating strips of hook and loop material to each other on said holder to maintain said holder in a tightly rolled configuration with said nipple extending from one end of said holder.

3. The method of claim 1, further comprising the steps of:

a) placing a generally rectangular pacifier holder on a flat work surface with a pacifier attachment strap positioned upwardly;

b) selecting a pacifier having a hollow pacifier handle for attachment to the pacifier holder;

c) looping the pacifier attachment strap through the pacifier handle with a nipple of the pacifier extending away from the pacifier holder;

d) attaching a proximate end of the pacifier strap to a mating piece of hook and loop material located at a distal end of the strap;

e) grasping corners on an end of the pacifier holder nearest the pacifier;

f) rolling the pacifier holder rightly towards an opposite side of the pacifier holder; and, g) attaching mating strips of hook and loop material to each other on said holder to maintain said holder in a tightly rolled configuration with said nipple extending from one end of said holder.

* * * * *